US009511822B2

(12) United States Patent
Hillbohm

(10) Patent No.: US 9,511,822 B2
(45) Date of Patent: Dec. 6, 2016

(54) BOAT WITH A DISPLACEABLE FREEBOARD SECTION

(71) Applicant: Lars Hillbohm, Skutskär (SE)

(72) Inventor: Lars Hillbohm, Skutskär (SE)

( * ) Notice: Subject to any disclaimer, the term of this patent is extended or adjusted under 35 U.S.C. 154(b) by 0 days.

(21) Appl. No.: 14/904,509

(22) PCT Filed: Jul. 10, 2014

(86) PCT No.: PCT/SE2014/050886

§ 371 (c)(1),
(2) Date: Jan. 12, 2016

(87) PCT Pub. No.: WO2015/005864

PCT Pub. Date: Jan. 15, 2015

(65) Prior Publication Data

US 2016/0167745 A1 Jun. 16, 2016

(30) Foreign Application Priority Data

Jul. 12, 2013 (SE) ..... 1350876

(51) Int. Cl.
*B63B 3/56* (2006.01)
*B63B 19/08* (2006.01)

(52) U.S. Cl.
CPC ..... *B63B 19/08* (2013.01); *B63B 3/56* (2013.01); *B63B 2019/083* (2013.01)

(58) Field of Classification Search
CPC ..... B63B 19/08; B63B 3/56
See application file for complete search history.

(56) References Cited

U.S. PATENT DOCUMENTS 3,808,998 A * 5/1974 Molotzak ..... B63B 1/22 114/126
4,058,461 A 11/1977 Gaw
5,043,065 A * 8/1991 Propp ..... E02B 15/048 210/242.3
5,102,540 A * 4/1992 Conradi ..... E02B 15/046 210/232
5,191,854 A 3/1993 Lehmann et al.
5,628,274 A * 5/1997 Biedenweg ..... B63B 21/00 114/362
7,401,566 B1 7/2008 Miknich

FOREIGN PATENT DOCUMENTS

DE 3732507 A1 4/1989
WO 01/36262 A1 5/2001

* cited by examiner

*Primary Examiner* — Stephen Avila
(74) *Attorney, Agent, or Firm* — Dilworth & Barrese, LLP

(57) ABSTRACT

A boat has at least one portion (3, 4) of the freeboard in the region of the stem of the boat arranged movable from a closed position, in which it seals the space (6) inside the freeboard with respect to the exterior of the boat, and an open position, in which it provides an opening (21) between the exterior of the boat and space so as to enable to pick up objects from the water in which the boat floats through the opening. The freeboard portion is arranged to be displaceable along the floor (11) of the space for moving the freeboard portion from the closed to the open position and then gradually increase the width of the opening (21).

20 Claims, 2 Drawing Sheets

BOAT WITH A DISPLACEABLE FREEBOARD SECTION

FIELD OF THE INVENTION AND BACKGROUND ART

The present invention relates to a boat with at least a portion of the freeboard in the region of the stem of the boat arranged to be moved between a closed position, in which it seals the space inside the freeboard with respect to the exterior of the boat, and an opened position, in which it provides an opening between the exterior of the boat and said space so as to enable to pick up objects from the water in which the boat floats through said opening.

The invention relates to boats having such a movable freeboard portion so as to enable to pick up all types of objects from the water, such as when fishing, decontamination work and saving of persons in distress or the like. However, the latter application will mainly be discussed hereinafter, i.e. a said boat with the main task to function as life boat, so as to illuminate the invention and the problem to be solved thereby, but accordingly not in any way restrict the invention thereto.

It is known for known boats of the type mentioned above to arrange said freeboard portion in the form of a stem lid which may be folded down for providing a said opening. This means a number of disadvantages. This lid may for obvious reasons only have a restricted width so as to not give the boat a shape strongly restricting the driving ability thereof. The restricted width means that it may sometimes be difficult to carry out work for picking up distressed persons from the water, especially in high sea. Another disadvantage of such a lid is that it attends to constitute an obstacle and disturb the saving work and prevent persons to be picked up in a satisfying way. Furthermore, the size of the opening is fixed and may not be adapted to exactly the work to be carried out for the moment with the boat.

SUMMARY OF THE INVENTION

The object of the present invention is to provide a boat of the type defined in the introduction, which at least partly solves any of the above problems of such boats already known.

This object is according to the invention obtained by in such a boat arrange said freeboard portion displaceable along a floor of said space for moving the freeboard portion from the closed to the open position and by that gradually increase the width of the opening.

By arranging the freeboard portion displaceable the width of said opening may be adapted to the conditions prevailing, but it primarily gets possible to provide an opening being larger than in case of a foldable lid would that be desired. By displacing the freeboard portion along the floor of the space, i.e. the floor of the boat, this freeboard portion will not in any way constitute any obstacle when picking up objects, such as persons in distress, from the water.

According to an embodiment of the invention the freeboard portion is arranged to be displaceable along and inside a fixed part of the freeboard of the boat for moving the freeboard portion from the closed to the open position, through which the freeboard portion may be moved smoothly away when persons shall be picked up from the water.

According to another embodiment of the invention the freeboard portion is arranged to be displaced along and outside a fixed part of the freeboard of the boat for moving the freeboard portion from the closed to the open position. Space may in this way be saved inside the fixed part of the freeboard of the boat.

According to another embodiment of the invention the freeboard portion is arranged to be displaced in the direction of the stern so as to be moved from the closed to the open position and according to a further development of this embodiment the freeboard portion has one end configured to in the closed position be located at the tip of the stem of the boat, and the freeboard portion is arranged to be displaced so as to provide a said opening from said stem tip and rearwardly. This is a suitable place to have said opening for saving people in distress.

According to another embodiment of the invention the freeboard portion has a curved shape participating in definition of the stem of the boat in the closed position and is configured to change shape and adapt the shape to and be displaced along and inside or outside a fixed part of the freeboard of the boat when displacing the freeboard portion from the closed to the open position. The boat may by this have the same shape in the stem as it would have if it wouldn't be equipped with any movable freeboard portion in that region in spite of the presence of such a freeboard portion. This means that the driving ability of the boat is not influenced in any way by the existence of said freeboard portion.

According to a further development of the embodiment last mentioned the freeboard portion is formed by a plurality of plate-like members interconnected through hinges configured to enable pivoting of the members with respect to each other for said shape change of the freeboard portion. The hinges may then be formed by butt hinges arranged between the members.

But according to another embodiment of the invention the freeboard portion is instead made bendable for said shape change, which accordingly is achieved through a suitable choice of material and thickness of the freeboard portion.

According to another embodiment of the invention the freeboard portion is along at least parts of its extension at the top provided with reinforcement rims. This increases the stability and durability of the boat in the stem thereof, and such reinforcement rims are particularly advantageous in the case of forming the freeboard portion of said plate-like members for stiffening the freeboard portion at least in the closed position by then bridging said hinges.

According to another embodiment of the invention the freeboard portion has at the bottom first engagement members arranged in engagement with second engagement members fixed with respect to the floor of the space so as to guide the freeboard portion when displacing it between said closed and open position. The freeboard portion may by this safely and easily be moved between said two positions.

According to another embodiment of the invention the boat has a power arrangement designed to displace the freeboard portion between closed and open position, which facilitates the displacement of the freeboard portion and may be a necessity for larger boats, even if the boat according to the invention in some applications could provide a displaceability through for example a manually operated crank or the like.

The power arrangement may then advantageously comprise a power member able to change its length substantially in the longitudinal direction of the boat and connected to said freeboard portion. This power member may for example be an hydraulic cylinder and advantageously be arranged in the region of the stern of the boat.

According to another embodiment of the invention the boat has a water-tight bulk head arranged on the stern side of said space for preventing water possibly entering said space through said opening to reach further rearwardly in the boat, and the bulk head has a door for transferring objects picked up from the water from said space and rearwardly in the boat.

The boat may by this be opened up in the stem for picking up persons in distress from the water and it is nevertheless ensured that the boat is not filled with water, but a person saved may then by opening said door smoothly be moved into the interior of the boat for be taken care of.

According to a further other embodiment of the invention the boat comprises weight means arranged to be displaceable in the longitudinal direction of the boat for displacing the centre of gravity of the boat in that direction and by that raising and lowering the floor in said space with respect to the surface of the water the boat is floating in. Said weight means may then advantageously comprise a driver compartment of the boat, which could be displaceable for example on rails. It will by this be possible to lower the floor in said space with respect to a surface of the water when saving people in distress and by that facilitate a picking up of the persons from the water.

According to another embodiment of the invention the boat has two said freeboard portions, one on each side of the tip of the stem of the boat, which enables an opening of the stem of the boat in both directions, both to starboard and port, and providing a large opening when desired.

The boat may have a stem stop with means for securing the two freeboard portions thereto in the closed position thereof. This stem stop is then preferably to be moved away, such as foldable in the direction of the stern downwardly towards said floor, when displacing said end of the freeboard portions away from the stem stock, so that the space gets entirely open in the stem and the stem stock will not in any way constitute any obstacle. The ability to move the stem stock away may then be accomplished in another way, such through a telescopic design of the stem stock. The stem stock may also be arranged to be folded in the direction of the stem so that it may be used as gangway for landing.

Further advantages as well as advantageous features of the invention will appear from the following description of an embodiment of the invention.

BRIEF DESCRIPTION OF THE DRAWINGS

With reference to the appended drawings, below follows a specific description of an embodiment of the invention cited as an example, in the drawings:

FIG. 4 is a perspective view of a boat according to FIG. 1 with one of the displaceable freeboard portions in open position and illustrating how a person in distress may be picked up from the water the boat floats in.

DETAILED DESCRIPTION OF AN EMBODIMENT OF THE INVENTION

Figure 1:
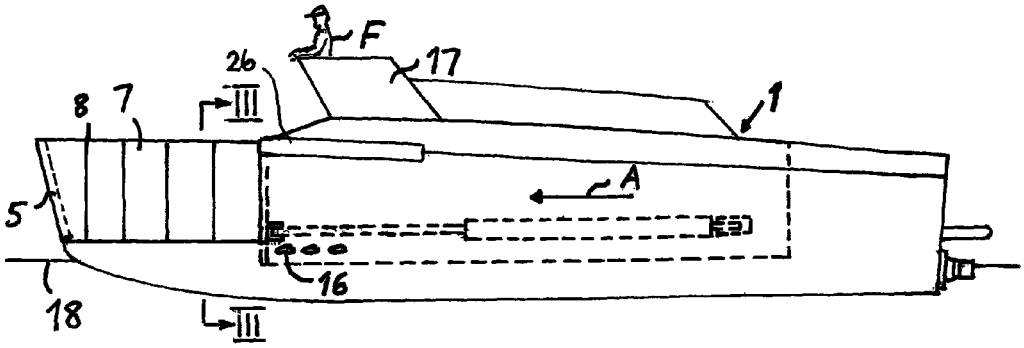
FIG. 1 is a simplified side elevation view of a boat according to an embodiment of the invention with two said freeboard portions in the closed position.
Figure 2:
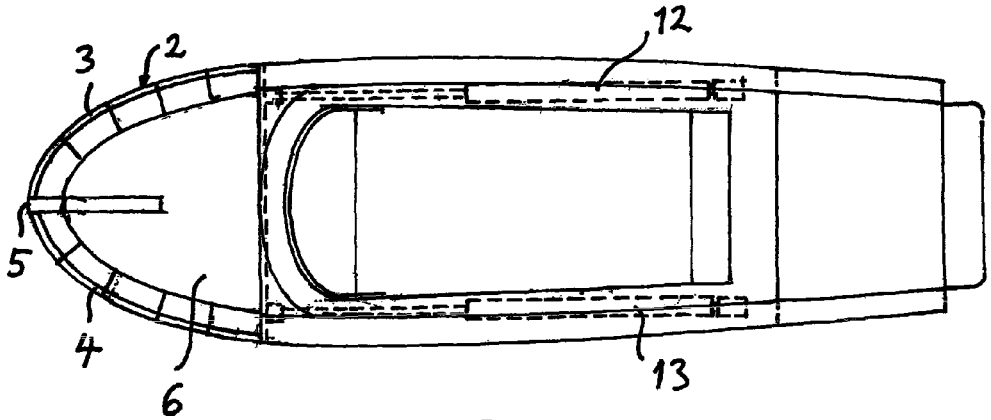
FIG. 2 is a view from above of the boat in FIG. 1.
Figure 3:
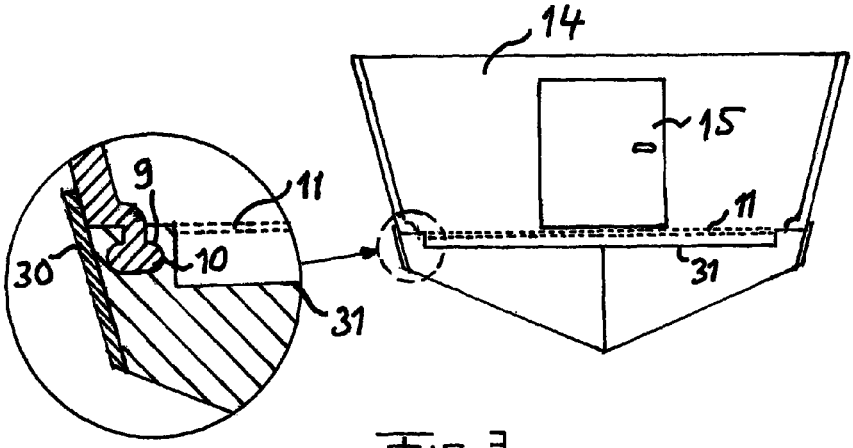
FIG. 3 is a view according to III-III in FIG. 1 with a part shown in an enlarged section.

A boat 1 according to an embodiment of the invention is simplifiedly shown in FIG. 1, and this is designed to primarily function as a life boat for saving people. Two freeboard portions 3, 4 are arranged in the stem 2 of the boat on each side of the tip of the stem of the boat which is defined by a so called stem stock 5. The freeboard portions are arranged to be displaced between closed position (according to FIGS. 1 and 2), in which they seal the space 6 inside the freeboard with respect to the exterior of the boat, and open position in which they provide an opening between the exterior of the boat and the space.

The respective freeboard portion is formed by a plurality of plate-like members 7 interconnected through hinges 8, such as butt hinges.

The plate-like members of the freeboard portions have at the bottom first engagement means 9 in the form of a male part arranged in engagement with a second engagement member 10 in the form of a female part fixed with respect to the floor 11 of the boat so as to guide the respective freeboard portion when displacing it between said closed and open position. An edge rim 30 projects upward for example about 80 mm and does then at the bottom support the members 7 in the closed position.

The boat has a power arrangement with two power members 12, 13 of the type changing its length, which are connected to a freeboard portion each so as to displace this between said two positions.

Figure 4:
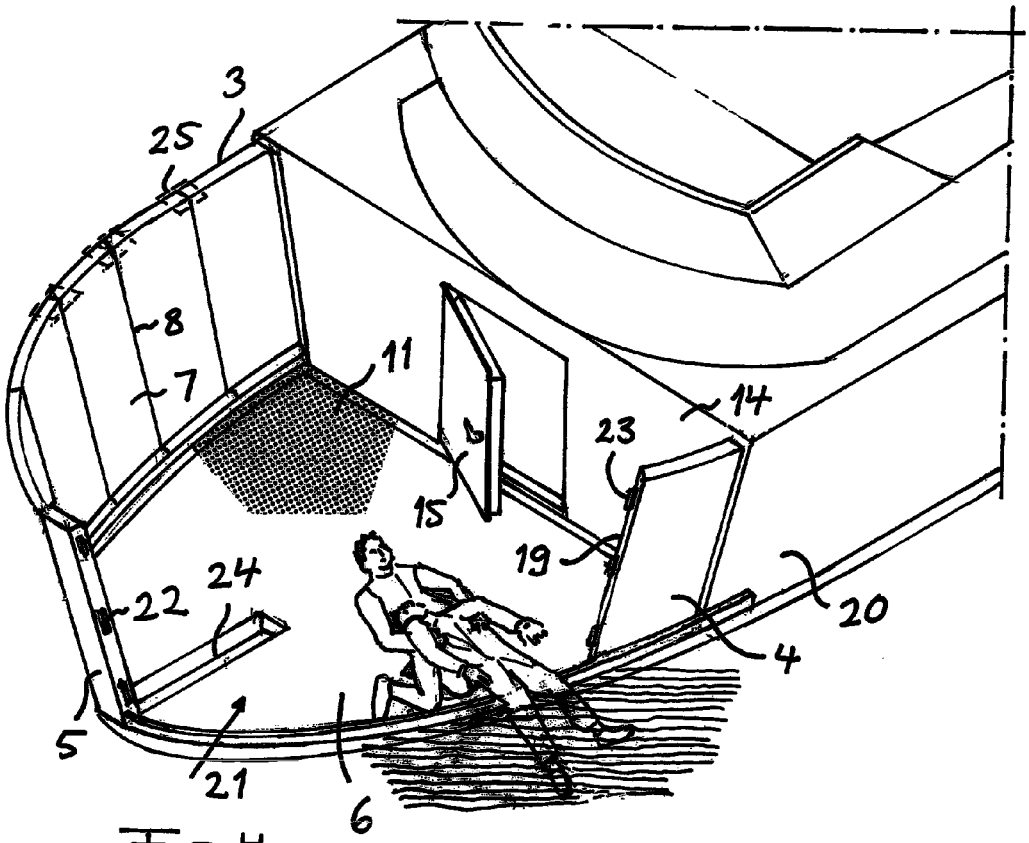
Figure 5:
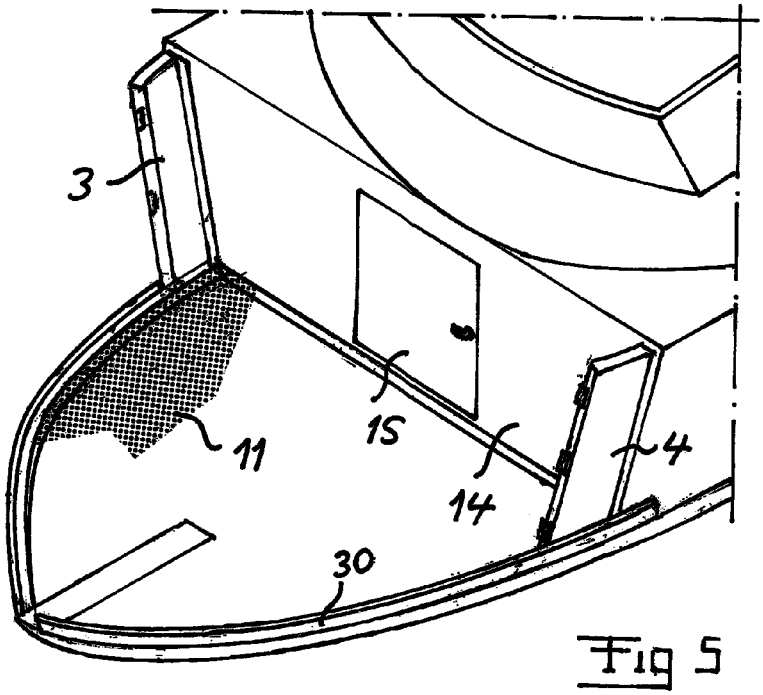
FIG. 5 is a view corresponding to FIG. 4 illustrating both freeboard portions in the open position.

The boat has a water-tight bulk head 14 arranged on the stern side of said space 6 so as to prevent water possibly entering the space through the opening formed when displacing any of the freeboard portions to reach further rearwardly in the boat. This bulk head has a door 15, such as a sliding door, for transferring objects picked up from the water, such as humans saved from the water, from the space and rearwardly in the boat. The floor 11 of the boat is in the space 6 formed by a grid being arranged at a distance above a tight floor surface 31. Portions of the grid are indicated in FIGS. 4 and 5. The water entering into the space 6 when any of the freeboard portions is in open position may flow through the grid and through the floor surface 31 rearwardly to scuppers 16 with non-return valves arranged behind the bulk head for letting water possibly entering the space through said opening out.

The driver compartment 17 of the boat may also be arranged displaceable in the longitudinal direction of the boat, which is indicated through the arrow A, for displacing the centre of gravity of the boat in the longitudinal direction and by that raising and lowering the floor 11 in the space with respect to the surface 18 of the water in which the boat floats.

The boat may also comprise a telescopical gunwale, which is arranged in a cell 26 (schematically shown in FIG. 1) on the stern side of one or both of the freeboard portions 3, 4 of the boat.

The function of the boat will now be described while making reference also to FIGS. 4 and 5. When one or several persons in distress shall be saved from the water the boat is driven with the stem closed to these persons and then is for instance one 13 of the power members actuated, such as shown in FIG. 4, for displacing one of the freeboard portions 4 with the end 19 thereof away from the stem stock 5, so that this freeboard portion is displaced along the floor 11 and along and entirely or partially inside a fixed part 20 of the freeboard of the boat. A large opening 21 is by that obtained for picking up persons in distress from the water on the floor 11 of the space 6. The freeboard portion 3 is then at the same time forming an efficient wind and wave protection. The driver compartment 17 may then advantageously be pushed forwardly to the position shown in FIG. 1 so that the distance between the floor 11 and the water surface 18 will be comfortably small and facilitate the saving work. The driver F has in this position also a good view of the saving situation and may control the boat in an optimum way. When then a person in distress has been picked up this may through opening the door 15 in the bulk head 14 be moved into the interior of the boat for taking care of, such as medical care.

It appears that the stem stock 5 has means in the form of recesses 22 for securing the two freeboard portions with respect thereto in the closed position by introducing suitable projections 23 at the end 19 thereof. The stem stock 5 is adapted to be folded down into a recess 24 in the floor 11 of the boat so as to be moved away and not constitute any obstacle in the case it would be desire to open the stem space 6 both starboards and ports, such as shown in FIG. 5. It is schematically illustrated in FIG. 4 through the dashing how reinforcement rims 25 may be arranged to extend transversally between adjacent plate-like elements 7 so as to bridge the hinge 8 therebetween.

The invention is of course not in any way restricted to the embodiment described above, but many possibilities to modifications thereof would be apparent to a person will skill in the art without departing from the scope of the invention as defined in the appended claims.

As already mentioned above the displaceable freeboard portions of the boat may be of a flexible material so as to change shape upon displacement thereof.

It would also be possible that the boat has only one said displaceable freeboard portion.

The invention claimed is:

1. A boat with at least a portion (3, 4) of the freeboard in the region of the stem (2) of the boat arranged to be movable between a closed position, in which it seals a space (6) inside a freeboard with respect to the exterior of the boat, and an open position, in which it provides an opening (21) between the exterior of the boat and said space so as to enable to pick up objects from the water in which the boat floats through said opening, wherein said freeboard portion (3, 4) is arranged to be displaceable along a floor (11) of said space for moving the freeboard portion from the closed to the open position and gradually increasing the width of said opening (21).

2. A boat according to claim 1, wherein said freeboard portion (3, 4) is arranged to be displaceable in the direction of the stern to be moved from the closed to the open position.

3. A boat according to claim 2, wherein said freeboard portion (3, 4) has an end (19) configured to be located at the tip of the stem of the boat in said closed position, and the freeboard portion is arranged to be displaceable to provide said opening from said stem tip and rearwardly.

4. A boat according to claim 1, wherein said freeboard portion (3, 4) has a curved shape participating in the definition of the stem (2) of the boat in the closed position and is configured to change shape and adapt its shape to and be displaced along and inside or outside a fixed part (20) of the freeboard of the boat when displacing the freeboard portion from the closed to the open position.

5. A boat according to claim 4, wherein said freeboard portion (3, 4) is formed by a plurality of plate-like members (7) interconnected through hinges (8) configured to enable pivoting of said members with respect to each other for said shape change of said freeboard portion.

6. A boat according to claim 4, wherein said freeboard portion is made bendable for said shape change.

7. A boat according to claim 1, wherein said freeboard portion (3, 4) is along at least parts of the extension thereof at the top provided with reinforcement rims (25).

8. A boat according to claim 5, wherein said freeboard portion (3, 4) is along at least parts of the extension thereof at the top provided with reinforcement rims (25), and said reinforcement rims (25) are designed to at least in the closed position extend transversely to and bridge said hinges (8).

9. A boat according to claim 1, wherein said freeboard portion (3, 4) at the bottom has first engagement members (9) in engagement with second engagement members (10) fixed with respect to the floor (11) of said space to guide the freeboard portion when displacing it between said closed and open position.

10. A boat according to claim 1, comprising a power arrangement configured to displace said freeboard portion (3, 4) between closed and open position.

11. A boat according to claim 10, wherein the power arrangement comprises a power member (12, 13) able to change its length substantially in the longitudinal direction of the boat and connected to said freeboard portion (3, 4).

12. A boat according to claim 11, wherein said power member (12, 13) is arranged in the region of the stem of the boat.

13. A boat according to claim 1, having a watertight bulkhead (14) arranged on the stern side of said space (6) to prevent water entering the space through said opening (21) to reach further rearwards in the boat, wherein said bulkhead has a door (15) for transferring objects picked up from the water from said space and rearwards in the boat.

14. A boat according to claim 1, comprising weight means (17) arranged displaceable in the longitudinal direction of the boat for displacing the centre of gravity of the boat in that direction and raising and lowering a floor (11) in said space (6) with respect to a surface of water in which the boat is floating.

15. A boat according to claim 14, wherein said weight means comprises a driver compartment (17) of the boat.

16. A boat according to claim 1, having two said freeboard portions (3, 4), one on each side of the tip of the stem of the boat.

17. A boat according to claim 3, having two said freeboard portions cine on each side of the tip of the stem of the boat, and a stem stock (5) with means (22, 23) for securing said two freeboard portions thereto in the closed position thereof.

18. A boat according to claim 17, wherein the stem stock (5) is arranged to be moved away, such as foldable towards the stern downwardly towards said floor (11), when displacing said end (19) of the freeboard portions (3, 4) away from the stem stock.

19. A boat according to claim 2, wherein said freeboard portion (3, 4) has a curved shape participating in the definition of the stem (2) of the boat in the closed position and is configured to change shape and adapt its shape to and be displaced along and inside or outside a fixed part (20) of the freeboard of the boat when displacing the freeboard portion from the closed to the open position.

20. A boat according to claim 3, wherein said freeboard portion (3, 4) has a curved shape participating in the definition of the stem (2) of the boat in the closed position and is configured to change shape and adapt its shape to and be displaced along and inside or outside a fixed part (20) of the freeboard of the boat when displacing the freeboard portion from the closed to the open position.

* * * * *